US007445421B2

(12) United States Patent
Sathianathan

(10) Patent No.: US 7,445,421 B2
(45) Date of Patent: Nov. 4, 2008

(54) FAN DUCT BLADE CONTAINMENT ASSEMBLY

(75) Inventor: Sivasubramaniam K. Sathianathan, Burton-Upon-Trent (GB)

(73) Assignee: Rolls-Royce plc, London (GB)

( * ) Notice: Subject to any disclaimer, the term of this patent is extended or adjusted under 35 U.S.C. 154(b) by 374 days.

(21) Appl. No.: 11/446,182

(22) Filed: Jun. 5, 2006

(65) Prior Publication Data

US 2006/0292002 A1 Dec. 28, 2006

(30) Foreign Application Priority Data

Jun. 23, 2005 (GB) ..... 0512758.4

(51) Int. Cl.
*F01D 21/00* (2006.01)

(52) U.S. Cl. ..... 415/9; 415/200; 415/220

(58) Field of Classification Search ..... 415/9, 415/200, 220; 60/39.091
See application file for complete search history.

(56) References Cited

U.S. PATENT DOCUMENTS 4,547,122 A 10/1985 Leech
5,336,044 A 8/1994 Forrester
6,543,991 B2 * 4/2003 Sathianathan et al. ..... 415/9
6,769,864 B2 * 8/2004 Sathianathan et al. ..... 415/9
6,971,841 B2 * 12/2005 Care ..... 415/9

FOREIGN PATENT DOCUMENTS

EP 1 245 791 A3 10/2002
EP 1 336 739 A3 8/2003

* cited by examiner

*Primary Examiner*—Ninh H Nguyen
(74) *Attorney, Agent, or Firm*—Oliff & Berridge, PLC

(57) ABSTRACT

The fan cowl (12) of a ducted fan gas turbine engine (10) has a downstream portion including an inner casing (30) that surrounds a honeycomb structure (36) in abutting engagement. Honeycomb structure (36) is made up of a number of closely spaced honeycomb blocks (36*a*) fixed about a liner (40), one or more of which blocks, if struck by a broken fan blade portion, will move relative to those not struck, in a radially outward direction, thus reducing the crushing force of the blow, and only flexing casing (30) instead of permanently deforming or puncturing it.

19 Claims, 2 Drawing Sheets

FAN DUCT BLADE CONTAINMENT ASSEMBLY

The present invention relates to a duct casing structure within one end of which a stage of aerofoil blades is mounted for operational rotation. More particularly, the duct structure is of the kind that includes an aerofoil blade containment assembly downstream of the blade stage, whereby broken off root portions of a disintegrated blade that pass down the duct are prevented from exiting the outermost duct wall structure.

It is known from published European patent specification EP 1 245 791 A2, to include an annular metallic panel structure of honeycomb chambered form within and abutting a wall surface of a duct outer casing. EP 1 245 791 A2 further discloses that the metallic panel structure may be a one piece structure, or alternatively, may comprise a plurality of smaller panels arranged circumferentially of the inner surface of the outer casing. In either arrangement, the axes of the honeycomb chambers are all radial to the casing. The radially inner ends of the honeycomb chambers are closed by an inner casing.

Whilst the known arrangement has proved able to contain a broken off blade root portion i.e. it has prevented a blade root portion from completely exiting the outer casing, the rigidity of the assembly is such as to fail to absorb sufficient of the blow before the blade root portion reaches the outer casing, with consequent plastic deformation or even puncturing of the outer casing.

The present invention seeks to provide an improved fan duct broken blade portion containment assembly.

According to the present invention, a fan duct broken blade containment assembly comprises an outer casing having surrounding contact with outer ends of a circumferential array of honeycomb cells that are attached to and surround an inner casing, the respective axes of which cells are radial to an axis common to said casings, said cells being arranged in close spaced blocks, which spacing enables radially outward movement of only the block or blocks struck by a broken off blade portion, and cause said outer casing to flex and thus reduce the shock load thereon.

The invention will now be described, by way of example and with reference to the accompanying drawings, in which.

Figure 1:
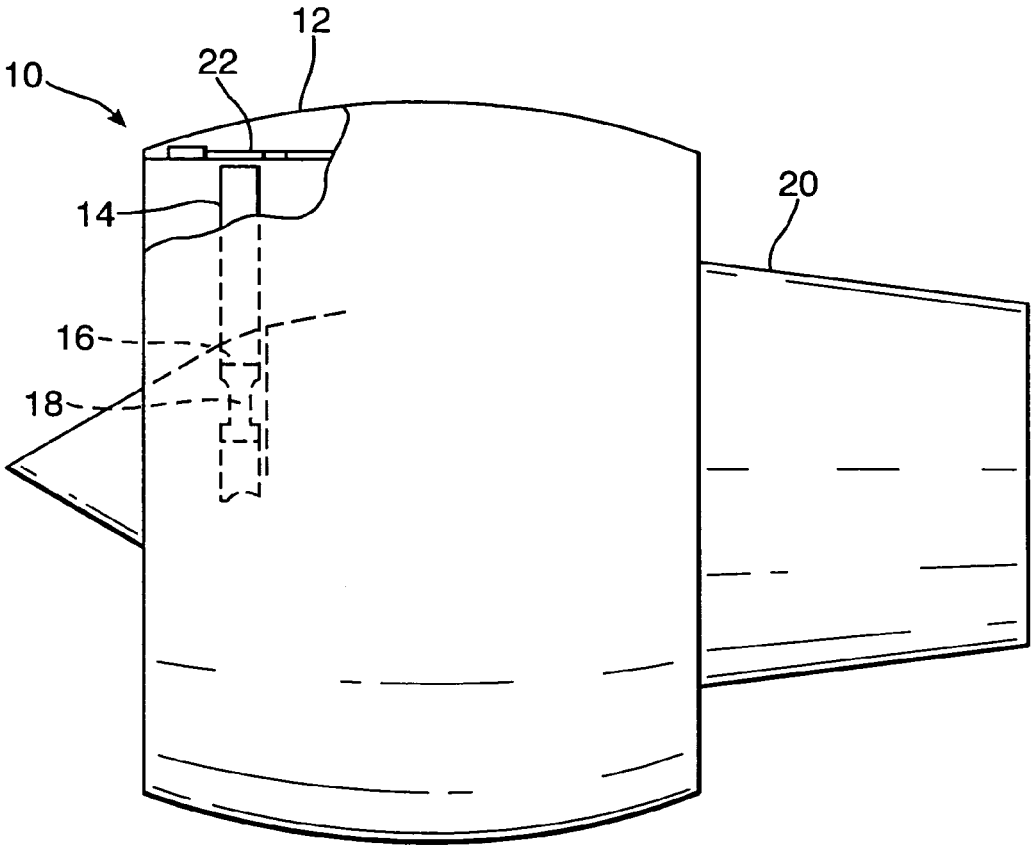
FIG. 1 is a diagrammatic view of a ducted fan gas turbine engine incorporating a fan duct blade containment assembly in accordance with the present invention.

Referring to FIG. 1. A ducted fan gas turbine engine, generally indicated by the numeral 10, includes a fan cowl 12 that surrounds a stage of fan blades 14, only one of which blades is shown. Each blade 14 locates, via a root portion 16, in a respective groove in the rim of a disk 18, which in turn is connected in known manner via shafting (not shown) to a turbine (not shown) within a casing 20.

Figure 2:
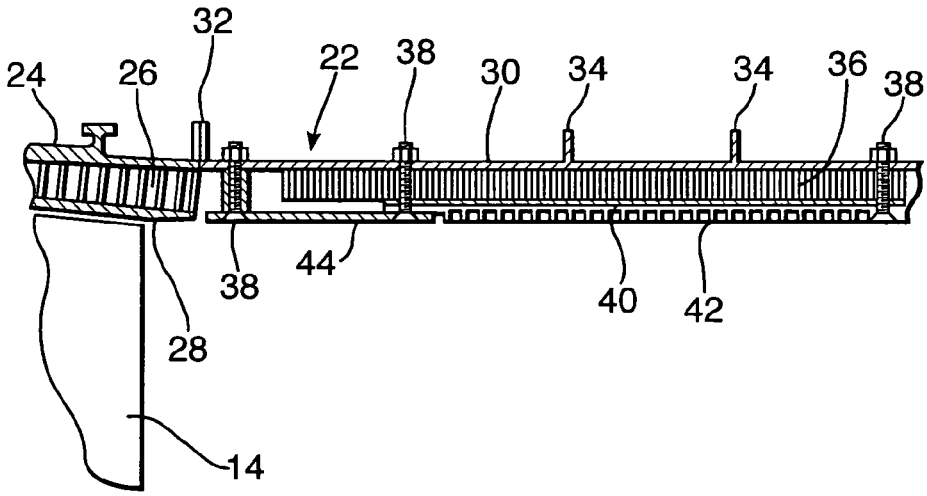
FIG. 2 is an enlarged axial cross sectional view of the fan duct blade containment assembly of FIG. 1.

Cowl 12 has an inner casing 22 consisting of an axially aligned assembly of casings that are more clearly seen in FIG. 2 to which reference is now made.

Referring to FIG. 2. Casing 22 consists of a first portion 24 that surrounds blade stage 14, and is lined with a honeycomb structure 26, which in turn is lined with a blade rubbing strip 28, in known manner. Honeycomb structure 26 prevents broken off blade aerofoil portions from passing through casing portion 24.

A second casing portion 30, the wall of which is thinner than that of casing 24, and therefor lighter, is connected to casing 24 via flanged joints 32. Casing portion 30 also has external circumferential stiffening flanges 34. A honeycomb cell structure 36 lies within casing 30. A plain metal liner 40, that is thinner than casing portion 30, lines honeycomb structure 36 and is fastened thereto by any suitable means, which for example, may be epoxy adhesives. A further, sound absorbing honeycomb structure 42, lines sheet metal liner 40, and an axial gap between honeycomb structure 26 and honeycomb structure 36 is bridged by a cylindrical piece 44. The assembly has radial fastenings in the form of nuts and bolts 38.

Figure 3:
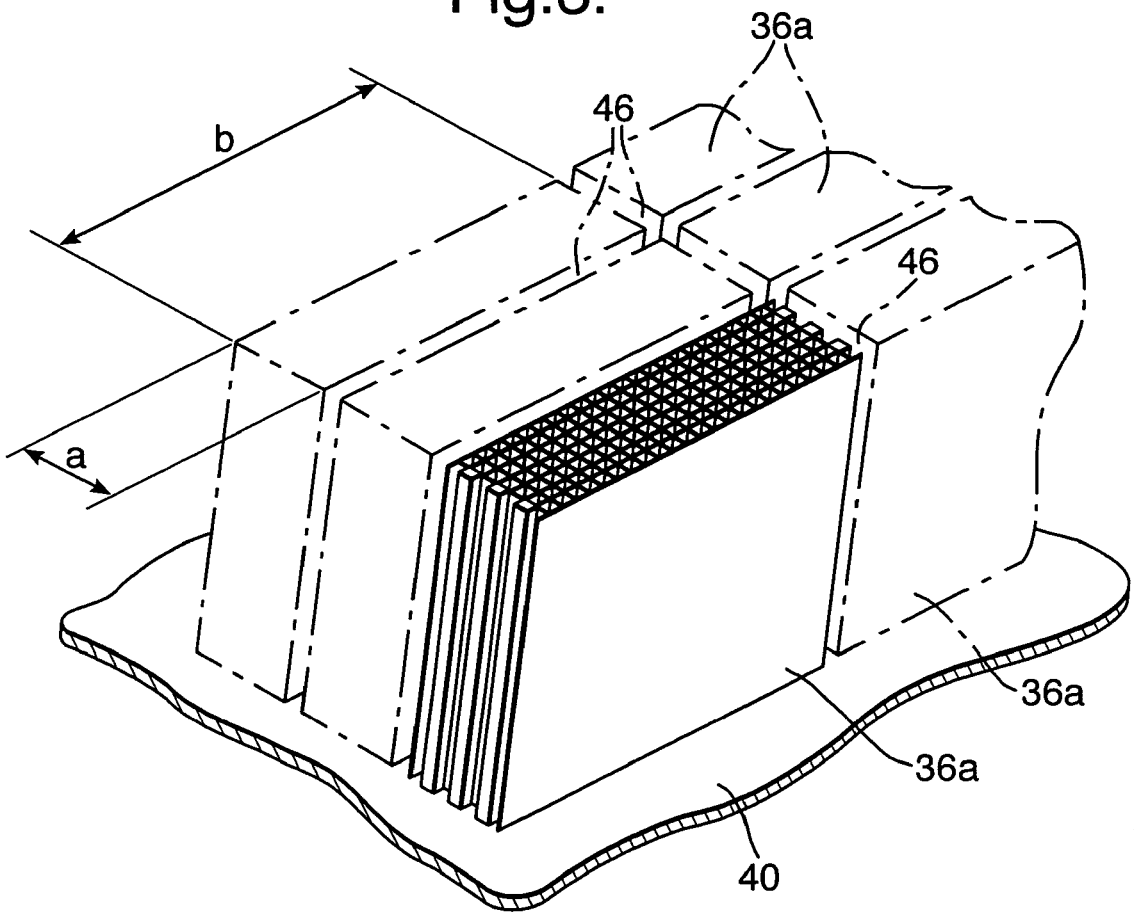
FIG. 3 is an enlarged pictorial part view of the fan duct blade containment assembly of FIG. 2.

Referring now to FIG. 3. Honeycomb cell structure 36 is assembled from a plurality of rectangular blocks **36*a* that are fixed in close spaced relationship with each other around metal liner 40. The spacing gaps shown and numbered 46 are much enlarged for clarity. Blocks 36*a* may be produced by first making larger pieces of honeycomb 36**, and then slicing through them with e.g. a high rotational speed steel cutting disk (not shown) of appropriate thickness.

Blocks **36*a* are identically proportioned. Thus, by way of example, where the dimension between opposing walls of each cell in each block 36*a*** is 3 mm to 6 mm, the dimensions "a" and "b", of respective sides of each block is 25 mm to 75 mm respectively.

Where the dimension between opposing walls of each cell is 6 mm to 10 mm, the dimensions "a" and "b" of respective sides of each block **36*a*** is 50 mm to 125 mm.

Where the dimension between opposing walls of each cell is 10 mm to 20 mm, the dimensions of "a" and "b" of respective sides of each block **36*a*** is 75 mm to 200 mm.

The ratio of the dimension between the opposing walls of each cell in block to the dimensions of the sides of the block is between 1 to 3 and 1 to 30. Preferably the ratio is between 1 to 3 and 1 to 25, more preferably the ratio is between 1 to 4 and 1 to 20. Specific examples are 1 to 4, 1 to 5, 1 to 7, 1 to 8, 1 to 10, 1 to 12.5 and 1 to 20.

Utilising a honeycomb structure 36 having opposing wall spacing of 3 mm and a wall thickness of 0.1 mm, provides the structure with a stabilised crush strength of 4000 psi (27.6 MPa).

On honeycomb structure 36 being struck by a broken off portion of blade root 16 (FIG. 1) that has penetrated acoustic liner 42 and liner 40, honeycomb structure 36 will not rigidly resist further penetration. Rather, only those blocks **36*a* the inner ends of which received the blow will both crush and at the same time, move radially outward of the axis of engine 10, and, by virtue of the abutting engagement of their outer ends with casing 30, will cause casing 30 to flex in the same direction. By this means, the effect of the force of the blow on the structure is reduced to the extent that the magnitude of crushing of the honeycomb structure 36 is reduced, and plastic deformation and puncturing of casing 30** is obviated.

The assembly, as described so far, includes acoustic honeycomb liner 42. However, honeycomb liner 42 could be obviated, the lengths of the cells of honeycomb structure 36 extended, and the diameter of liner 40 reduced, so as to enable their use for absorbing noise. In such an arrangement, liner 40 would be perforated in alignment with each cell interior, so as to enable receipt and absorbtion of noise from the fan duct.

Honeycomb structure 36 can be manufactured from any one of steel, aluminium, magnesium, titanium, nickel or alloys of any thereof, that has weight and strength characteristics appropriate to the environment in which honeycomb structure 36 is used.

EP 1 245 791 A2 discloses honeycomb panels, the axially spaced ends of which are bounded by annular flanges. Also disclosed is the separation of panels by axially aligned ribs.

Honeycomb blocks 36 of the present invention can be so bounded, (not shown), provided that any block or blocks 36 that receive a strike are not prevented from moving relative to the remainder, as described hereinbefore.

The cells of blocks 36 must be of identical form, which could be square, hexagonal, rectangular, or triangular.

I claim:

1. A fan duct broken blade containment assembly comprising an outer casing having surrounding contact with outer ends of a circumferential array of honeycomb cells, that are attached to and surround an inner casing, the respective axes of which cells are radial to an axis common to said casings, said cells being arranged in close spaced blocks thereof, which spacing enables radial outward movement of only the cell block or cell blocks struck by a broken off blade portion, and so cause said outer casing to flex and thus reduce the shock load thereon.

2. A fan duct broken blade containment assembly as claimed in claim 1 wherein the axially spaced ends of said circumferential array of honeycomb cell blocks are bounded by annular flanges.

3. A fan duct broken blade containment assembly as claimed in claim 2 wherein said honeycomb blocks are separated into circumferentially spaced groups, by ribs arranged axially of said inner casing.

4. A fan duct broken blade containment assembly as claimed in claim 1 wherein said inner casing is perforated so as to connect the interior of each cell in said honeycomb blocks with air flow through said inner casing, during operation of a ducted fan gas turbine engine when associated therewith.

5. A fan duct broken blade containment assembly as claimed in claim 1 wherein said honeycomb blocks are manufactured from steel or an alloy thereof.

6. A fan duct broken blade containment assembly as claimed in claim 1 wherein said honeycomb blocks are manufactured from aluminium or an alloy thereof.

7. A fan duct broken blade containment assembly as claimed in claim 1 wherein said honeycomb blocks are manufactured from magnesium or an alloy thereof.

8. A fan duct broken blade containment assembly as claimed in claim 1 wherein said honeycomb blocks are manufactured from titanium or an alloy thereof.

9. A fan duct broken blade containment assembly as claimed in claim 1 wherein said honeycomb blocks are manufactured from nickel or an alloy thereof.

10. A fan duct broken blade containment assembly as claimed in claim 1 wherein the form of all of the cells in all of the blocks is identical.

11. A fan duct broken blade containment assembly as claimed in claim 10 wherein the form of the cells is square.

12. A fan duct broken blade containment assembly as claimed in claim 10 wherein the form of the cells is rectangular.

13. A fan duct broken blade containment assembly as claimed in claim 10 wherein the form of the cells is hexagonal.

14. A fan duct broken blade containment assembly as claimed in claim 10 wherein the form of the cells is triangular.

15. A fan duct broken blade containment assembly as claimed in claim 1 wherein the ratio of the dimensions between the opposing walls of each cell in a block to the dimensions of the sides of the block is between 1 to 3 and 1 to 30.

16. A fan duct broken blade containment assembly as claimed in claim 15 wherein the dimensions between the opposing walls of each cell in each block is 3 mm to 6 mm and the dimensions of the sides of the block is 25 mm to 75 mm.

17. A fan duct broken blade containment assembly as claimed in claim 15 where in the dimensions between the opposing walls of each cell in each block is 6 mm to 10 mm and the dimensions of the sides of the block is 50 mm to 125 mm.

18. A fan duct broken blade containment assembly as claimed in claim 15 wherein the dimensions between the opposing walls of each cell in each block is 10 mm to 20 mm and the dimensions of the sides of the block is 75 mm to 200 mm.

19. A fan duct broken blade containment assembly as claimed in claim 1 wherein a further circumferential array of honeycomb cells is arranged within the inner casing.

* * * * *